US011575206B2

(12) United States Patent
Hu et al.

(10) Patent No.: US 11,575,206 B2
(45) Date of Patent: Feb. 7, 2023

(54) SELF-FILTERING WIDEBAND MILLIMETER WAVE ANTENNA

(71) Applicant: City University of Hong Kong, Hong Kong (HK)

(72) Inventors: Haotao Hu, Hong Kong (HK); Chi Hou Chan, Hong Kong (HK)

(73) Assignee: City University of Hong Kong, Hong Kong (HK)

( * ) Notice: Subject to any disclaimer, the term of this patent is extended or adjusted under 35 U.S.C. 154(b) by 0 days.

(21) Appl. No.: 17/351,281

(22) Filed: Jun. 18, 2021

(65) Prior Publication Data

US 2021/0399427 A1 Dec. 23, 2021

Related U.S. Application Data

(60) Provisional application No. 63/041,169, filed on Jun. 19, 2020.

(51) Int. Cl.
*H01Q 9/04* (2006.01)
*H01Q 21/06* (2006.01)

(52) U.S. Cl.
CPC ..... *H01Q 9/0457* (2013.01); *H01Q 21/065* (2013.01)

(58) Field of Classification Search
CPC .... H01Q 9/0457; H01Q 21/065; H01Q 13/10; H01Q 19/005; H01Q 5/378
See application file for complete search history.

(56) References Cited

U.S. PATENT DOCUMENTS 7,486,239 B1 * 2/2009 Channabasappa ... H01Q 9/0414 343/700 MS
9,653,810 B2 * 5/2017 Luk ..... H01Q 9/285
(Continued)

FOREIGN PATENT DOCUMENTS

CN 108258405 A 7/2018
CN 108923126 A 11/2018
(Continued)

OTHER PUBLICATIONS

Younsun Kim et al., "New Radio (NR) and Its Evolution Toward 5G-Advanced", IEEE Wireless Communications, vol. 26, Issue 3, pp. 2-7, Jun. 2019.
(Continued)

*Primary Examiner* — Jason Crawford
(74) *Attorney, Agent, or Firm* — Idea Intellectual Limited; Margaret A. Burke; Sam T. Yip

(57) ABSTRACT

The present invention provides a self-filtering millimeter-wave wideband multilayer planar antenna. The antenna includes a first layer having a slot feed. A second layer includes at least a pair of probes fed by the slot feed from the first layer. A third layer includes at least two substantially planar radiating patches each patch respectively coupled to one of the probes on the second layer. The radiating patches are arranged to radiate a millimeter-wavelength electromagnetic wave when the slot feed receives excitation energy and transmits the energy to the radiating patch through the respective probe. The self-filtering antenna does not require a resonant cavity structure coupled to the radiating patches. Antenna arrays of arbitrary numbers of antenna elements may be constructed from the self-filtering antenna. Such arrays are particularly suitable for 5G mm-wave backhaul communications.

9 Claims, 14 Drawing Sheets

(56) References Cited

U.S. PATENT DOCUMENTS

| | | | | |
|---|---|---|---|---|
| 9,865,928 | B2 * | 1/2018 | Sudo | H01Q 1/38 |
| 9,941,596 | B2 | 4/2018 | Zhang et al. | |
| 10,347,990 | B2 | 7/2019 | Zhang et al. | |
| 2001/0003443 | A1 | 6/2001 | Velazquf7 et al. | |
| 2004/0104839 | A1 | 6/2004 | Velazquez et al. | |
| 2007/0273459 | A1 | 11/2007 | Puoskari et al. | |
| 2010/0052813 | A1 | 3/2010 | Okabe | |
| 2012/0236924 | A1 | 9/2012 | Sahlin et al. | |
| 2013/0049900 | A1 | 2/2013 | Chung et al. | |
| 2014/0307599 | A1 | 10/2014 | Rousu | |
| 2015/0009079 | A1 | 1/2015 | Bojer | |
| 2015/0145735 | A1 | 5/2015 | Fan et al. | |
| 2017/0294717 | A1 | 10/2017 | Zhang et al. | |
| 2018/0034156 | A1 | 2/2018 | Zhang et al. | |
| 2018/0166788 | A1 | 6/2018 | Pan et al. | |
| 2019/0089069 | A1 * | 3/2019 | Niroo | H01Q 13/10 |
| 2020/0212530 | A1 * | 7/2020 | Zhu | H01P 1/2088 |
| 2020/0212531 | A1 * | 7/2020 | Mai | H01Q 1/50 |
| 2020/0212552 | A1 * | 7/2020 | Zhu | H01Q 9/0407 |
| 2021/0028556 | A1 * | 1/2021 | Brar | H01Q 21/062 |
| 2021/0376479 | A1 * | 12/2021 | Chan | H01Q 21/062 |
| 2021/0376483 | A1 * | 12/2021 | Chan | H01Q 21/0037 |
| 2021/0399427 | A1 * | 12/2021 | Hu | H01Q 21/0075 |

FOREIGN PATENT DOCUMENTS

| | | | |
|---|---|---|---|
| CN | 109066072 | A | 12/2018 |
| CN | 109103580 | A | 12/2018 |
| CN | 109921177 | A | 6/2019 |
| CN | 110265778 | A | 9/2019 |
| CN | 110544822 | A | 12/2019 |

OTHER PUBLICATIONS

Chen Yu et al., "Ku-Band Linearly Polarized Omnidirectional Planar Filtenna", IEEE Antennas and Wireless Propagation Letters, vol. 11, pp. 310-313, Mar. 2012.

Yazid Yusuf et al., "Compact Low-Loss Integration of High-Q 3-D Filters With Highly Efficient Antennas", IEEE Transactions on Microwave Theory and Techniques, vol. 59, Issue 4, pp. 857-865, Apr. 2011.

Yazid Yusuf et al., "A Seamless Integration of 3-D Vertical Filters With Highly Efficient Slot Antennas", IEEE Transactions on Antennas and Propagation, vol. 59, Issue 11, pp. 4016-4022, Nov. 2011.

Yazid Yusuf et al., "Co-Designed Substrate-Integrated Waveguide Filters with Patch Antennas." IET Microwaves, Antennas & Propagation, vol. 7, Issue 7, pp. 493-501, May 2013.

Hui Chu et al., "A 3-D Millimeter-Wave Filtering Antenna With High Selectivity and Low Cross-Polarization", IEEE Transactions on Antennas and Propagation, vol. 63, Issue 5, pp. 2375-2380, May 2015.

Kirti Dhawj et al., "Half-Mode Cavity-Based Planar Filtering Antenna With Controllable Transmission Zeroes", IEEE Antennas and Wireless Propagation Letters, vol. 17, Issue 5, pp. 833-836, May 2018.

Peng Kai Li et al., "Codesigned High-Efficiency Single-Layered Substrate Integrated Waveguide Filtering Antenna With a Controllable Radiation Null", IEEE Antennas and Wireless Propagation Letters, vol. 17, Issue 2, pp. 295-298, Feb. 2018.

Kun-Zhi Hu et al., "Compact, Low-Profile, Bandwidth-Enhanced Substrate Integrated Waveguide Filtenna", IEEE Antennas and Wireless Propagation Letters, vol. 17, Issue 8, pp. 1552-1556, Aug. 2018.

Hui Chu et al., "Implementation of Synthetic Material in Dielectric Resonator-Based Filtering Antennas", IEEE Transactions on Antennas and Propagation, vol. 66, Issue 7, pp. 3690-3695, Jul. 2018.

P. F. Hu et al., "A Compact Filtering Dielectric Resonator Antenna With Wide Bandwidth and High Gain", IEEE Transactions on Antennas and Propagation, vol. 64, Issue 8, pp. 3645-3651, Aug. 2016.

Sheng Jie Yang et al., "Low-Profile Dual-Polarized Filtering Magneto-Electric Dipole Antenna for 5G Applications", IEEE Transactions on Antennas and Propagation, vol. 67, Issue 10, pp. 6235-6243, Oct. 2019.

Yapeng Li et al., "Differentially Fed, Dual-Band Dual-Polarized Filtering Antenna With High Selectivity for 5G Sub-6 GHz Base Station Applications", IEEE Transactions on Antennas and Propagation, vol. 68, Issue 4, pp. 3231-3236, Apr. 2020.

Kin Xu et al., "E-Band Plate-Laminated Waveguide Filters and Their Integration Into a Corporate-Feed Slot Array Antenna With Diffusion Bonding Technology", IEEE Transactions on Microwave Theory and Techniques, vol. 64, Issue 11, pp. 3592-3603, Nov. 2016.

Jiaguo Lu et al., "Broadband Dual-Polarized Waveguide Slot Filtenna Array With Low Cross Polarization and High Efficiency", IEEE Transactions on Antennas and Propagation, vol. 67, Issue 1, pp. 151-159, Jan. 2019.

Abbas Vosoogh et al., "An Integrated Ka-Band Diplexer-Antenna Array Module Based on Gap Waveguide Technology With Simple Mechanical Assembly and No Electrical Contact Requirements", IEEE Transactions on Microwave Theory and Techniques, vol. 66, Issue 2, pp. 962-972, Feb. 2018.

Chin-Kai Lin et al., "A Filtering Microstrip Antenna Array", IEEE Transactions on Microwave Theory and Techniques, vol. 59, Issue 11, pp. 2856-2863, Nov. 2011.

Chun-Xu Mao et al., "An Integrated Filtering Antenna Array With High Selectivity and Harmonics Suppression", IEEE Transactions on Microwave Theory and Techniques, vol. 64, Issue 6, pp. 1798-1805, Jun. 2016.

Fu-Chang Chen et al., "Design of Filtering Microstrip Antenna Array With Reduced Sidelobe Level", IEEE Transactions on Antennas and Propagation, vol. 65, Issue 2, pp. 903-908, Feb. 2017.

Hao-Tao Hu et al., "A Differential Filtering Microstrip Antenna Array With Intrinsic Common-Mode Rejection", IEEE Transactions on Antennas and Propagation, vol. 65, Issue 12, pp. 7361-7365, Dec. 2017.

Rashad H. Mahmud et al., "High-Gain and Wide-Bandwidth Filtering Planar Antenna Array-Based Solely on Resonators", IEEE Transactions on Antennas and Propagation, vol. 65, Issue 5, pp. 2367-2375, May 2017.

Fu-Chang Chen et al., "X-Band Waveguide Filtering Antenna Array With Nonuniform Feed Structure", IEEE Transactions on Microwave Theory and Techniques, vol. 65, Issue 12, pp. 4843-4850, Dec. 2017.

Hui Chu et al., "A Millimeter-Wave Filtering Monopulse Antenna Array Based on Substrate Integrated Waveguide Technology", IEEE Transactions on Antennas and Propagation, vol. 64, Issue 1, pp. 316-321, Jan. 2016.

Hui Chu et al., "A Filtering Dual-Polarized Antenna Subarray Targeting for Base Stations in Millimeter-Wave 5G Wireless Communications", IEEE Transactions on Components, Packaging and Manufacturing Technology, vol. 7, Issue 6, pp. 964-973, Jun. 2017.

Huayan Jin et al., "Integration Design of Millimeter-Wave Filtering Patch Antenna Array With SIW Four-Way Anti-Phase Filtering Power Divider", IEEE Access, vol. 7, pp. 49804-49812, Apr. 2019.

Chun-Xu Mao et al., "Multimode Resonator-Fed Dual-Polarized Antenna Array With Enhanced Bandwidth and Selectivity", IEEE Transactions on Antennas and Propagation, vol. 63, Issue 12, pp. 5492-5499, Dec. 2015.

Yao Zhang et al., "Dual-Band Base Station Array Using Filtering Antenna Elements for Mutual Coupling Suppression", IEEE Transactions on Antennas and Propagation, vol. 64, Issue 8, pp. 3423-3430, Aug. 2016.

Chun-Xu Mao et al., "A Shared-Aperture Dual-Band Dual-Polarized Filtering-Antenna-Array With Improved Frequency Response", IEEE Transactions on Antennas and Propagation, vol. 65, Issue 4, pp. 1836-1844, Apr. 2017.

Yi-Ming Zhang et al., "A Wideband Filtering Antenna Array With Harmonic Suppression", IEEE Transactions on Microwave Theory and Techniques, vol. 68, Issue 10, pp. 4327-4339, Oct. 2020.

Gui Liu et al., "Compact Filtering Patch Antenna Arrays for Marine Communications", IEEE Transactions on Vehicular Technology, vol. 69, Issue 10, pp. 11408-11418, Oct. 2020.

(56) References Cited

OTHER PUBLICATIONS

K. M. Luk et al., "Broadband Microstrip Patch Antenna", Electronics letters, vol. 34, Issue 15, pp. 1442-1443, Jul. 1998.
Qian Zhu et al., "Substrate-Integrated-Waveguide-Fed Array Antenna Covering 57-71 GHz Band for 5G Applications", IEEE Transactions on Antennas and Propagation, vol. 65, Issue 12, pp. 6298-6306, Dec. 2017.
Jun Xu et al., "Wideband, Low-Profile Patch Array Antenna With Corporate Stacked Microstrip and Substrate Integrated Waveguide Feeding Structure", IEEE Transactions on Antennas and Propagation, vol. 67, Issue 2, pp. 1368-1373, Feb. 2019.

* cited by examiner

SELF-FILTERING WIDEBAND MILLIMETER WAVE ANTENNA

FIELD OF THE INVENTION

The present invention generally relates to self-filtering antennas and, more particularly, to wideband self-filtering antennas for millimeter-wave applications.

BACKGROUND OF THE INVENTION

Due to the merits of low insertion loss, high power capacity, and ease of integration, SIW (substrate integrated waveguide) technology is being developed for high-performance microwave/millimeter-wave components such as filters and antennas. In the past, filters and antennas were separately designed and connected with transmission lines. However, this architecture suffers from a large size as well as significant insertion loss introduced by the filter and its connection circuits.

More recently, a new component, called a filtering antenna, has been introduced. For example, US 2020/0212530 shows a filtering antenna in which radiating antenna patches are coupled to a series of resonant cavities that perform the filtering function. While this overall structure performs both filtering and radiating functions, it is still an antenna coupled to a filter, albeit in an integrated package. Filtering antennas assist in meeting the requirement of highly-integrated radio front ends. However, prior art filtering antennas suffer from relatively narrow bandwidth.

However, filtering antennas merely integrate and miniaturize the separate functions of filtering and radiating; they do not operate in a manner different from conventional unintegrated filters and antenna. Thus, there is a need in the art for a fundamentally different approach to antenna design in which the antenna and its feed structure itself contribute to perform the filtering function. Such an antenna, referred to in the present specification as a "self-filtering antenna" could be used in 5G millimeter-wave (mm-wave) communications.

SUMMARY OF THE INVENTION

In one aspect, the present invention provides a self-filtering millimeter-wave wideband multilayer planar antenna. The antenna includes a first layer having a slot feed. A second layer includes at least a pair of probes fed by the slot feed from the first layer. A third layer includes at least two substantially planar radiating patches each patch respectively coupled to one of the probes on the second layer. The radiating patches are arranged to radiate a millimeter-wavelength electromagnetic wave when the slot feed receives excitation energy and transmits the energy to the radiating patch through the respective probe. The self-filtering antenna does not require a resonant cavity structure. Antenna arrays of arbitrary numbers of antenna elements may be constructed from the self-filtering antenna. Such arrays are particularly suitable for 5G mm-wave backhaul communications.

In another aspect, the self-filtering millimeter-wave wideband multilayer planar antenna may be described as including a probe layer with one or more probes that receive excitation energy and which function as an inductor and capacitor in series. A patch layer positioned above the probe layer includes at least two substantially planar radiating patches coupled to one or more of the probes on the probe layer. The radiating patches are configured to radiate millimeter-wavelength electromagnetic waves. The radiating patches function as an inductor, a capacitor, and a resistor in parallel. The coupling of the planar radiating patches to the one or more probes on the probe layer is such that the capacitor function of the probes coupled with the inductor function of the patches creates the function of a high-pass filter, causing the antenna to be self-filtering.

DETAILED DESCRIPTION

A. Self-Filtering Antenna Overview

Figure 1:
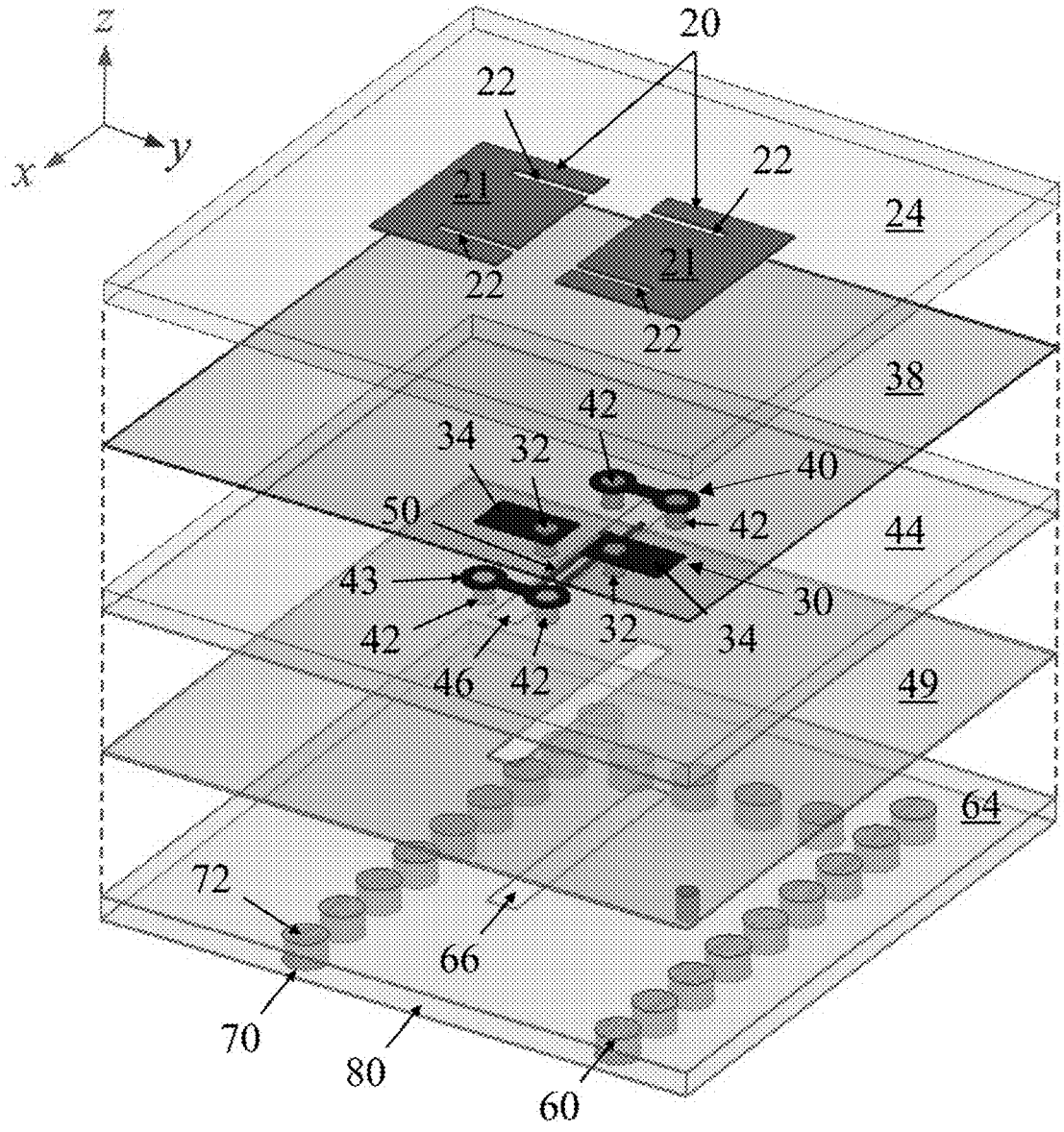
FIG. 1 is a perspective view, with parts separated, of a self-filtering antenna according to an embodiment.

The proposed antenna is a 3-layer structure shown in FIGS. 1 and 2. The bottom layer is an SIW feeding structure. A slot is etched on the upper plane of the SIW. Near the slot, there is a matching pole. On both sides of the slot, in the middle layer, there are two vias individually connected to a horizontal strip, forming two mirrored L-shaped probes. In the top layer are the radiating patches. The present invention provides a self-filtering wideband millimeter wave antenna that uses an SIW feeding structure. The novel approach uses SIW-fed radiating patches without needing extra filtering circuits. By utilizing the combination of slot-coupled-fed and differential probe-fed structures, characteristics of wide impedance bandwidth, low profile and adequate filtering response in the lower stopband are obtained. The introduced slots on the radiating patches and the shorting loops on top of the coupling slot together contribute to generate a good filtering response in the upper stopband.

By means of introducing a pair of shorted stubs in the coupling slot region, radiation suppression level in the lower stopband is further improved. Without requiring any dedicated filtering circuits, the present self-filtering antenna possesses sufficient filtering characteristics, wide impedance bandwidth as well as low profile.

FIG. 1 depicts a perspective view of the configuration of self-filtering antenna 10 according to an embodiment. The self-filtering antenna includes three substrate layers 24, 44, and 64 having the following features: radiating antenna patches 20, probes 30, optional shorting loops 40, optional shorted stubs 50, an SIW feeding structure 60, and slots 46 and 66. The two symmetrical radiating patches 20 include a planar conductor 21 disposed on an insulating substrate 24 such as a printed circuit board. In one embodiment, the length and width of each individual radiating patch may be selected to be approximately 0.32 $\lambda_g$ and 0.5 $\lambda_g$, where $\lambda_g$ is a guided wavelength at a central operating frequency. The planar conductors 21 of the radiating patches include a pair of slots 22 that may be formed by etching or by printing the radiating patches including the slot structure. The slots 22 are selected to have a length of approximately ¼ of a wavelength at an upper cutoff frequency. Transmission in the upper antenna stopband is considerably suppressed through the use of slots 22. This is due to the fact that when slots 22 are working at quarter-wavelength resonance, energy will be accumulated at the vicinity of the slots. The radiation due to the induced currents will cancel out each other as these currents are reversely oriented.

A second insulating substrate 44 is positioned beneath the first insulating substrate 24. Etched in a lower surface of substrate 44 in a metal layer is coupling slot 46. On opposite sides of the coupling slot 46 are probes 30. Probes 30 include two conductive vias 32 each individually connected to two horizontal strips 34 on the upper surface of the second insulating substrate 44. The combination of the vias 32 and strips 34 creates two mirrored L-shaped probes 30. The length of L-shaped probe is determined by the position of the selected lower cutoff frequency. Since the structure is highly symmetrical and the height of probes 30 is quite low, the self-filtering antenna experiences low cross polarization in addition to a low-profile wideband characteristic. Further, the feeding structure assisting in obtaining a certain degree of filtering response in the lower stopband of the antenna. The position of a lower pass-band edge can be controlled by changing the length of probe. The length of the probe is approximately a quarter wavelength at a cut-off frequency in the lower band of the antenna.

Positioned in the second insulating substrate 44 over the coupling slot 46 are optional shorting loops 40. The shorting loops 40 include plural conductive vias 42 as well as conductors 43 contacting the conductive vias 42. The conductors may optionally be circularly shaped (other shapes are also acceptable) and are separated by a predetermined distance. The predetermined separation distance may be selected to be approximately ½ of a wavelength of a central operating frequency. The length of coupling slot may be slightly longer than this selected separation distance.

Since the height of the circular conductors is low due to the small thickness of substrate 44, the circular conductors act as shorting bridges connecting two sides of the coupling slot 46 at low frequencies. The fundamental resonant frequency related to the coupling slot is determined by the distance between these two circular conductors rather than by the length of the coupling slot.

In the vicinity of coupling slot 46 is a pair of shorted stubs 50 disposed in the insulating substrate 44 which connect to an upper plane of a surface integrated waveguide, discussed below. Alternatively, the shorted stubs 50 may be located in the upper plane of insulating substrate 64, adjacent to the coupling slot 66. The shorted stubs 50 work at approximately ¼ wavelength of a lower antenna stopband. The shorted stubs in the coupling slot region further improve the radiation suppression in the lower stopband. In addition to the selected lengths and separation distances of the self-filtering antenna elements, the geometry of the elements is optimized for obtaining good impedance matching as well as the filtering response.

A third insulating substrate 64 is positioned beneath the second insulating substrate 44. A slot 66 is etched on the upper plane (a metal layer) of insulating substrate 64. Slot 66 couples energy coupling from a feeding structure 70 to the patch radiating elements 20. Feeding structure 70 includes a substrate integrated waveguide (SIW) including plural conductive vias 72 in a predetermined pattern that receives energy from input port 80. An optional conductive post 85 is provided in the third insulating substrate 64. The conductive post 85 provides better impedance matching. As a result, the self-filtering antenna has a wide impedance bandwidth with good impedance matching level.

B. Self-Filtering Antenna Function

In operation, energy that is fed from the input port 80 will enter the SIW structure. The energy is then coupled to the probes 30 through the slot 66, the slot in the second bonding film 49 and the slot 46. Finally, the energy will go to the radiating patches by the coupling between the probes and the radiating patches. In the present of the shorting loops 40, a portion of parasitic radiation of the slot 46 is suppressed, resulting in a better suppression level in the upper stopband of the self-filtering antenna. Moreover, the slots 46 and 66 can be extended while maintaining good antenna performance consequently, there is more space for putting the shorting stubs 50 in the slot 46 or slot 66. The shorting stubs 50 help to improve the suppression level in the lower stopband of the self-filtering antenna.

Figure 18B:
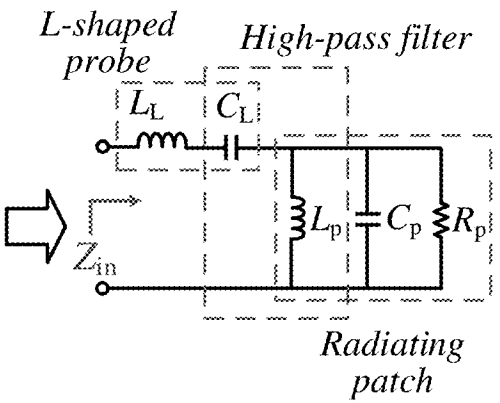
FIGS. 18A-18B depict an equivalent circuit for an antenna including several of the elements of FIG. 1.
Figure 18A:
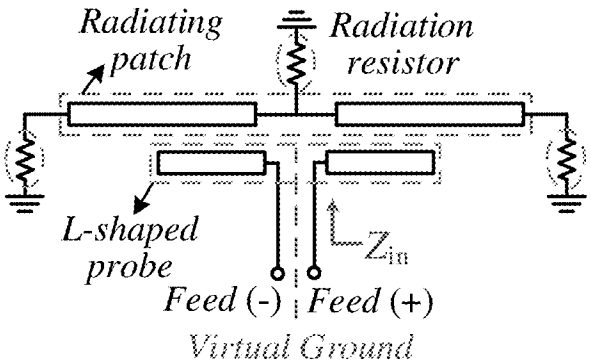

An equivalent circuit for the radiating patch 21, probes 30, and slots 46 and 66 of the self-filtering antenna of FIG. 1 is depicted in FIGS. 18A-18B. The coupling slot in the SIW feeding structure is simplified as two polarity-opposing feed ports (+, −). To reduce the complexity of the structure, a virtual ground in the middle of the antenna can be assumed, leaving only one half of the circuit to be analyzed. The equivalent circuit of the right antenna half, for example, has been extracted. The L-shaped probe 30 as well as the coupling between the probe 30 and radiating patch 21 can be modeled by a series LC circuit in series with the parallel RLC circuit of the patch. Within the operating frequency band, it is a two-pole band-pass circuit network, thus contributing to wide impedance bandwidth. However, away from the operating frequency, the series capacitance together with the parallel inductance forms a two-stage high-pass filter. As a consequence, it is difficult for the low-frequency signals to propagate to the radiating patch 21, resulting in radiation suppression. At the lower stopband frequencies, the energy concentrates in the region between the probe and patch; this kind of energy cannot well radiate as the induced currents are oppositely oriented. In this case, the energy can only be reflected back to the feeding port. However, at the operating (pass-band) frequencies, the radiating patches can be well excited to radiate energy.

The values of the capacitances and inductances can be controlled by the size of the probe 30 and the patch 21 as well as the coupling between the probe 30 and patch 21. To minimize the impact on the in-band performance as far as possible, controlling the probe length is preferred for tuning the pass-band edge. It can be found that the length of the probe is approximately a quarter wavelength at cut-off frequency in the lower band. Therefore, the expression for the cut-off frequency in the lower band can be estimated as:

$$f_{cut\text{-}off,lower} \approx \frac{c}{4(L_L + h)\sqrt{\varepsilon_r}} \quad (1)$$

where h is the height of the probe via (also the thickness of substrate 44) $L_L$ is a length of the probe horizontal portion 34, c is the speed of light and $\varepsilon_r$ is the relative dielectric constant of the substrate 44.

Upper stopband suppression may be controlled using patch slots 22. As discussed above, while these slots are working at quarter-wavelength resonance, energy will be accumulated at the vicinity of the slots. The radiation due to the induced currents will cancel out each other as these currents are reversely oriented. Surface currents on the radiating patches, indicate that, at the operating (pass-band) frequencies, most of the currents travel in the same direction, resulting in good radiation. The position of the upper pass-band edge may be determined by selecting appropriate length of the patch slot 22. Thus, the expression for cut-off frequency in the upper band can be approximately $$f_{cut\text{-}off,upper} \approx \frac{c}{4L_{s1}\sqrt{\varepsilon_r}} \quad (2)$$

where $L_{S1}$ is the length of the radiating patch slot 22.

To obtain better suppression level, the two shorting loops 40 at the ends of the coupling slot are provided. By incorporating the two shorting loops 40, in upper stopband frequencies, the currents on the patches 21 as well as the electric field in the coupling slot 46 are further reduced, contributing to better radiation suppression. Since the height of the loops is quite low due to the thin substrate 44, the loops 40 can be regarded as shorting bridges connecting two sides of the coupling slot 46 at low frequencies. In this case, the fundamental resonant frequency related to the coupling slot is determined by the distance between these two loops rather than the length of the coupling slot. The distance between the two loops plays a role in controlling the resonant mode generated by the coupling slot, while the length of the coupling slot should be slightly longer than the distance between the loops in order to achieve better impedance matching level.

The filtering response can be further improved by enhancing the lower stopband suppression through the use of shorted stubs 51 and 52 in the coupling slot 46 (or located in the coupling slot 66). Up to 5-dB suppression is achieved through the use of stubs 51 and 52. The stubs work at quarter wavelength with current distributions in opposite directions, such that their radiation effects cancel each other. For achieving better radiation suppression, the lengths of stubs 51 and 52 are slightly different.

C. Self-Filtering Antenna Examples and Testing

Example 1: Single Self-Filtering Antenna

The self-filtering antenna of FIG. 1 is constructed on a multilayer printed circuit board (PCB) using three substrate layers (all are Rogers RT/duroid 5880 with a thickness h of 0.381 mm, dielectric constant $\varepsilon_r$ of 2.2, and loss-tangent $\delta$ of 0.0009) as well as two different kinds of bonding films (Bonding film 38: Rogers 3001 with a thickness of 0.0381 mm, dielectric constant of 2.28, and loss-tangent of 0.003; Bonding film 49: Rogers COOLSPAN thermally and electrically conductive adhesive (TECA) bonding films with a thickness of 0.05 mm).

Figure 2A:
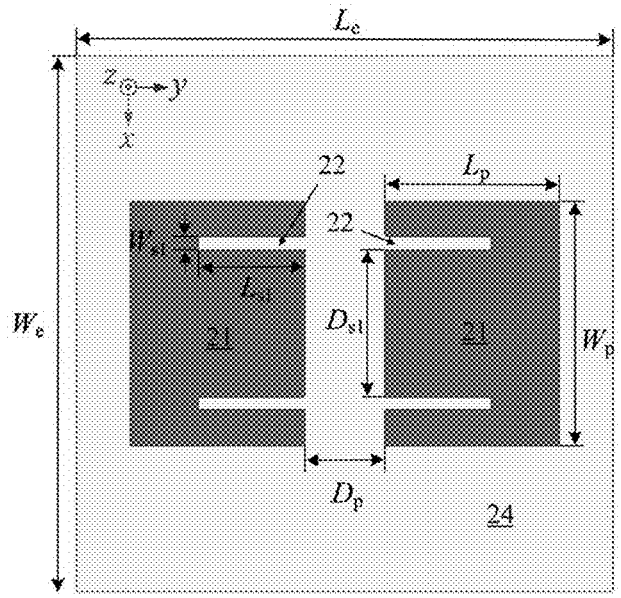
FIGS. 2A-2C depict top views of three layers of the self-filtering antenna of FIG. 1.
Figure 2B:
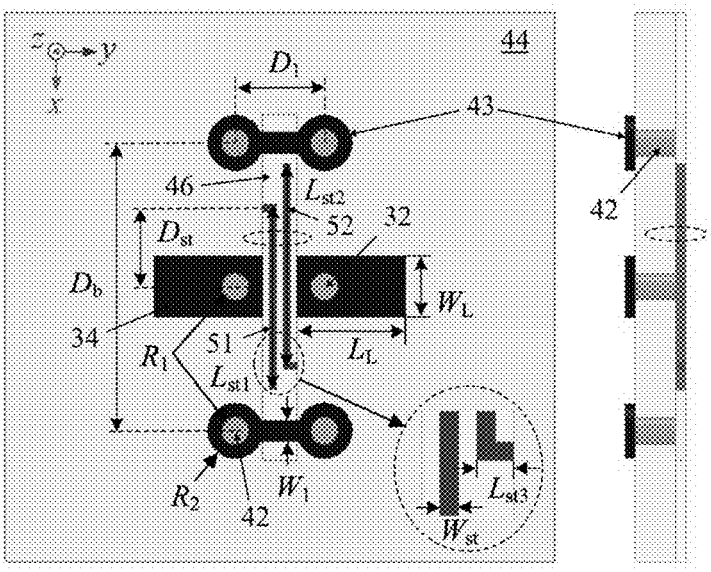
Figure 2C:
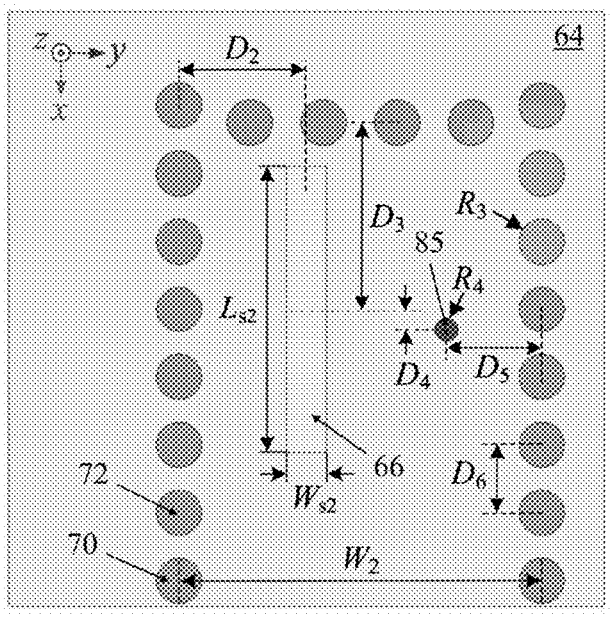

FIGS. 2A-2C depict top views of the three substrate layers of FIG. 1 with the element sizes and distances between elements depicted. As seen in FIG. 2A, $L_e$ is the length of a side/edge of substrate 24 and $W_e$ is the width of a side/edge of substrate 24. $L_p$ is the length of a side of radiating patch 21 and $W_p$ is the width of radiating patch 21. $D_P$ is the inter-patch distance. $D_{S1}$ is the distance between adjacent slots on a patch. $L_{s1}$ is the length of patch slot 22 and $W_{s1}$ is the width of patch slot 22.

As seen in FIG. 2B, $L_L$ is the length of a horizontal portion of probe 34 and $W_L$ is the width of horizontal portion of probe 34. $L_{s2}$ is the length of slot 66 and $W_{s2}$ is the width of slot 66. $L_{st1}$ is the length of stub 51 and $W_{st}$ is the width of stub 51 as seen in FIG. 2B. $L_{st2}$ is the length of stub 52 and $W_{st}$ is the width of stub 52 (FIG. 2B). $W_l$ is the width of the conductive metal trace forming loop 52 while $D_l$ is the inter-loop separation distance. $D_b$ is the vertical separation between adjacent loop pairs. $R_l$ is the radius of probe via 32 and loop via 42 while $R_2$ is the radius of the circular conductors 43.

As seen in FIG. 2C, $W_2$ is the separation distance between SIW conductive vias 72. $D_2$ is the distance from one edge of the SIW to the center of slot 66. $D_3$ is the distance from the end of the SIW to the center of slot 66. $R_4$ is the radius of post 85 while $D_4$ is the distance from the center of post 85 to a line through the center of slot 66. $D_5$ is the distance from the center of post 85 to the other edge of the SIW. $D_6$ is the inter-via spacing for the SIW path. $R_3$ is the radius of an SIW via 72.

Table 1 depicts the values for the above parameters for the self-filtering antenna measured in this example:

TABLE 1

DIMENSIONS OF THE FILTERING ANTENNA ELEMENT (UNIT: mm)

| | | | | | | | | |
|---|---|---|---|---|---|---|---|---|
| Parameter | $W_e$ | $W_p$ | $W_L$ | $W_{s1}$ | $W_{s2}$ | $W_{st}$ | $W_1$ | $W_2$ |
| Value | 15 | 3.65 | 0.9 | 0.15 | 0.5 | 0.1 | 0.3 | 6.4 |
| Parameter | $L_e$ | $L_p$ | $L_L$ | $L_{s1}$ | $L_{s2}$ | $L_{st1}$ | $L_{st2}$ | $L_{st3}$ |
| Value | 15 | 2.6 | 1.58 | 1.58 | 5.05 | 2.73 | 3.23 | 0.2 |
| Parameter | $D_p$ | $D_{s1}$ | $D_{st}$ | $D_b$ | $D_1$ | $D_2$ | $D_3$ | $D_4$ |
| Value | 1.2 | 2.4 | 1.1 | 4.4 | 1.3 | 2.25 | 3.3 | 0.37 |
| Parameter | $D_5$ | $D_6$ | $R_1$ | $R_2$ | $R_3$ | $R_4$ | | |
| Value | 1.68 | 1.2 | 0.2 | 0.4 | 0.4 | 0.2 | | |

Figure 3:
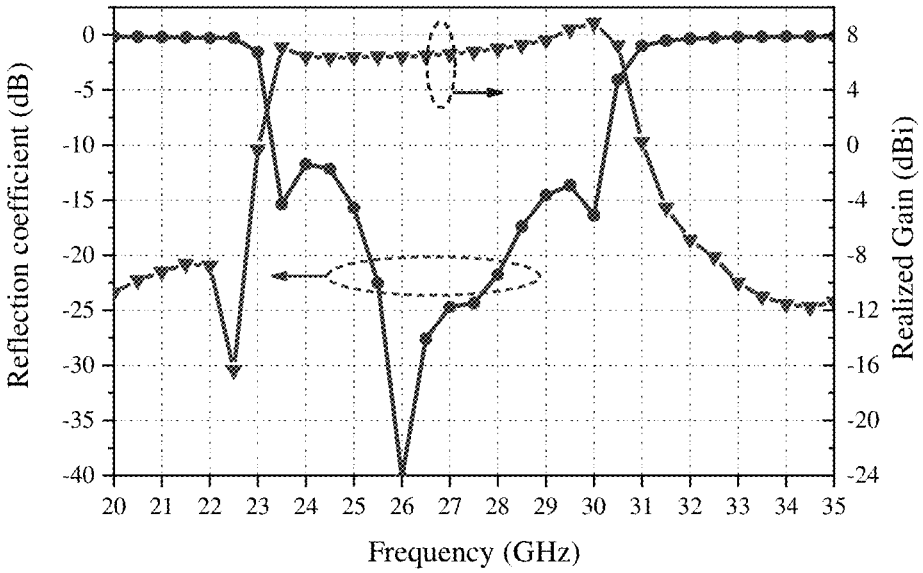
FIG. 3 depicts the simulated reflection coefficient and realized gain of a self-filtering antenna according to an embodiment.
Figure 4A:
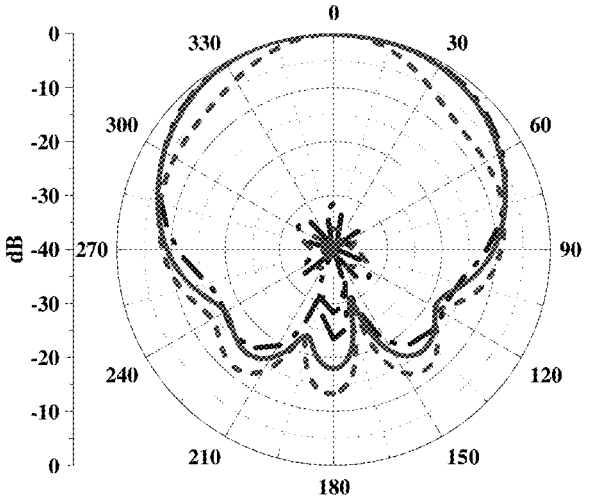
FIGS. 4A-4B depict simulated radiation patterns of a self-filtering antenna.
Figure 4B:
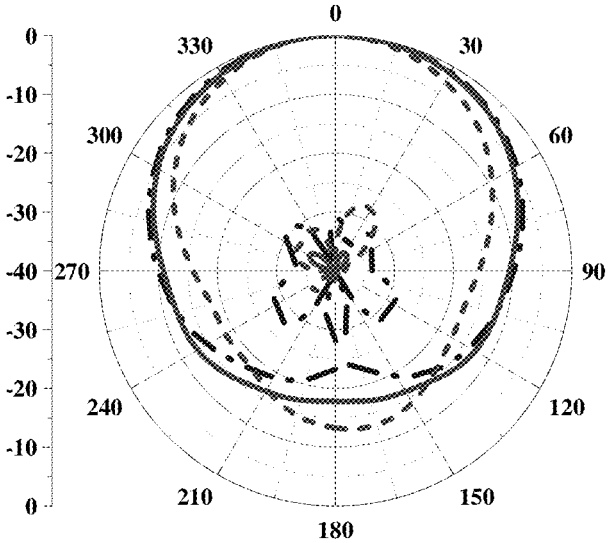

The simulated $|S_{11}|$ and realized gain responses are depicted in FIG. 3. As seen in FIG. 3, the −10 dB impedance bandwidth covers 25.8%, from 23.3 GHz to 30.2 GHz with a maximum realized gain of 8.9 dBi. The out-of-band suppression level is greater than 16 dB. FIGS. 4A-4B present the simulated radiation patterns of the self-filtering antenna in three operating frequencies (24 GHz, 27 GHz and 30 GHz). For conventional L-shaped probe antennas, the cross polarization tends to be somewhat high due to the radiation resulting from the via of the probe. In the inventive self-filtering antenna, due to the symmetrical structure as well as low profile of the probe, the cross polarizations in both the E- and H-planes are particularly low. Prior art filtering antennas suffer from very narrow bandwidth. In contrast, the self-filtering antenna without cascading any filtering circuits has a much wider bandwidth while maintaining its low profile, reasonable suppression level, as well as high gain performance.

Example 2: WIDEBAND SELF-FILTERING 4×4 ANTENNA ARRAY

Figure 5:
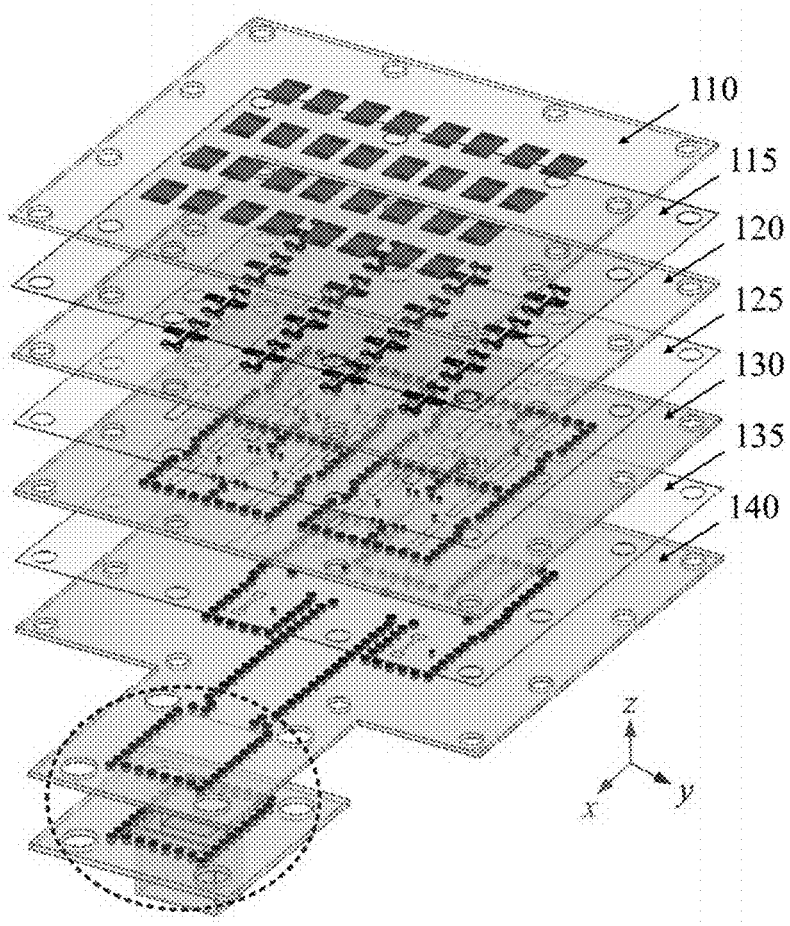
FIG. 5 depicts a 4×4 self-filtering antenna array according to an embodiment.

The self-filtering antenna of the present invention may be used in a self-filtering antenna array using an SIW feeding network. A 4×4 array based on the self-filtering antenna of FIG. 1 is depicted in FIG. 5. However, it is understood that the number of antenna elements in the antenna array may be arbitrarily selected according to the selected application.

Figure 6:
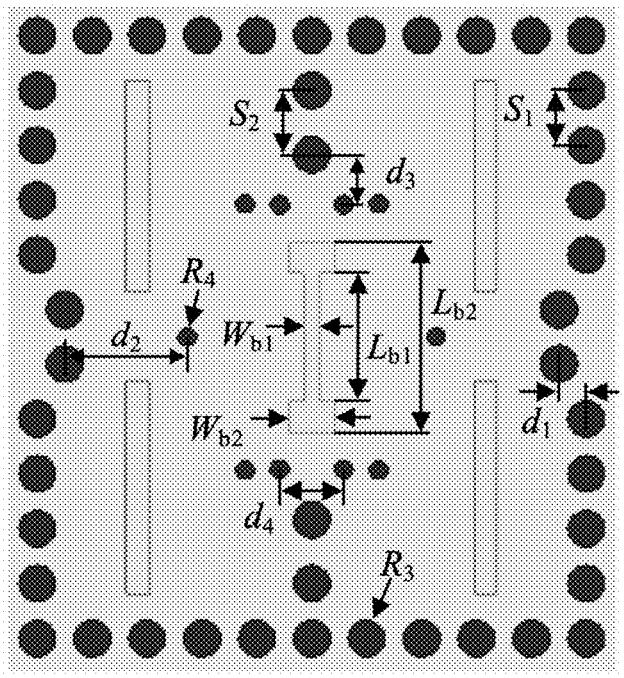
FIG. 6 depicts a top view of the broad wall coupler of the array of FIG. 5
Figure 7:
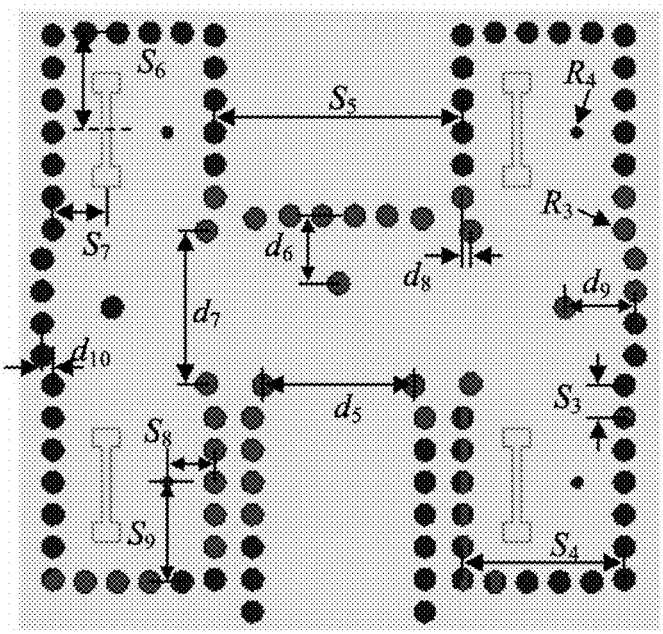
FIG. 7 depicts a top view of the H-shaped power divider of the array of FIG. 5
Figure 8A:
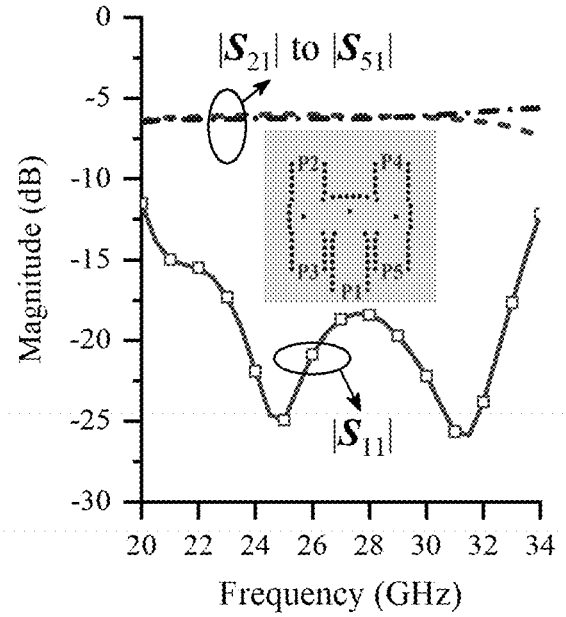
FIGS. 8A-8B depict the simulated performance of the H-shaped power divider and the broad-wall coupler, respectively.
Figure 8B:
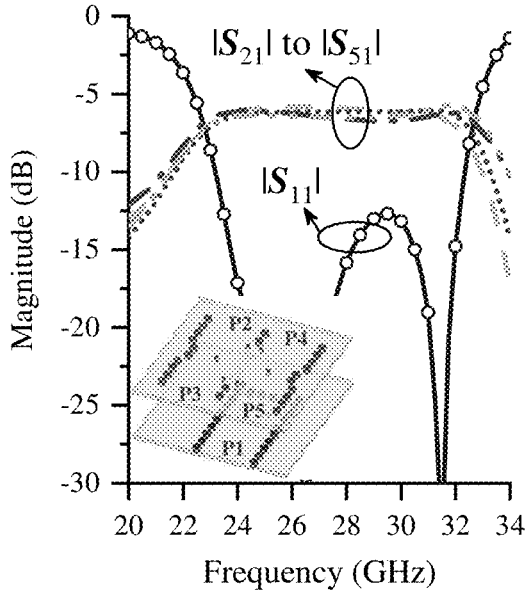

The array includes four insulating substrates 110, 120, 130, and 140 (0.381-mm-thick Rogers 5880 printed circuit board) and three pieces of bonding films 115, 125, and 135 in between. Similar to the self-filtering antenna of FIG. 1, Bonding Film 1 is Rogers 3001 with a thickness h of 0.0381 mm, while Bonding Films 2 and 3 are Rogers COOLSPAN TECA with a thickness of 0.05 mm. The antenna structures are printed on substrate 110 and substrate 120, while substrate 130 and substrate 140 are for the SIW feeding network. The separations between antenna elements along the x-axis and y-axis are respectively set as 6.6 mm (0.6 $\lambda_0$ at 27 GHz, $\lambda_0$ is free space wavelength) and 7.6 mm (0.68 $\lambda_0$ at 27 GHz). Under these separations, the mutual coupling among the radiating elements can be well below −10 dB. Two types of 1-to-4 power dividing networks as shown in FIGS. 6 and 7 compose the whole 1-to-16 feeding network. FIGS. 8A-8B depict the simulated performances of such two power dividing networks. FIG. 8A shows that the average in-band (23.5 GHz to 31 GHz) insertion loss for the H-shaped power divider of FIG. 7 is around 0.15 dB. Its 1-dB insertion loss bandwidth ranges from 20 GHz to 33.5 GHz. FIG. 8B shows that the broad-wall coupler of FIG. 6 has 1-dB and 3-dB insertion loss bandwidth that respectively ranges from 22.7 GHz to 32.2 GHz and from 22 GHz to 32.8 GHz. The average in-band insertion loss is about 0.25 dB. It is noted that the size of the slots in Bonding Films 125 and 135 is set to be 0.3 mm larger than that on the substrate boards given the alignment error in assembly as well as the melting effect in the heating process.

Waveguide-to-SIW Transition for Antennas and Arrays

Figure 9:
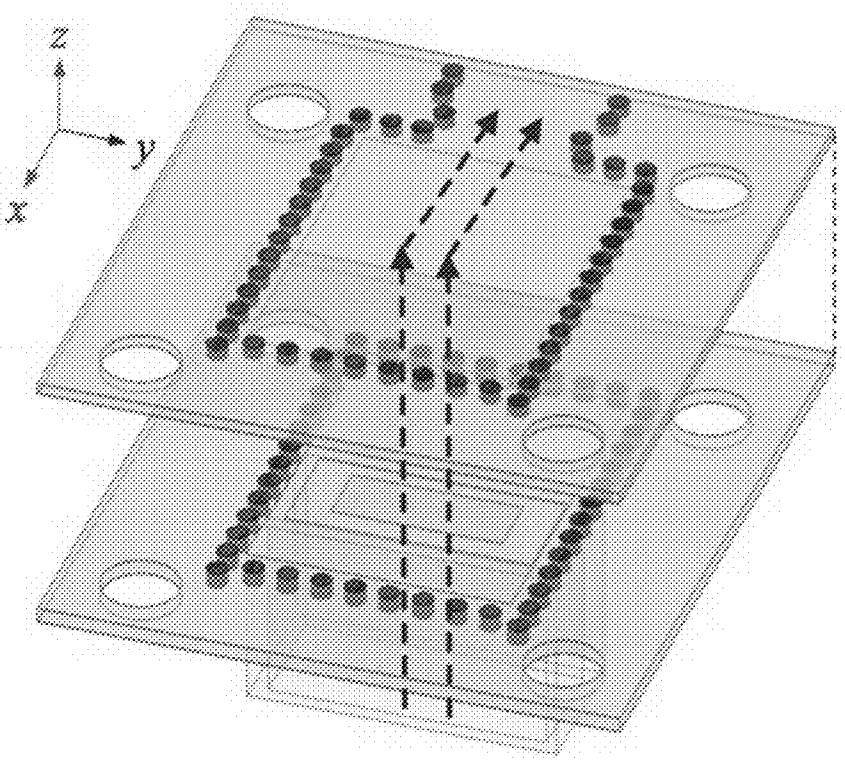
FIG. 9 depicts a perspective view of a configuration of a waveguide to SIW transition.
Figure 10:
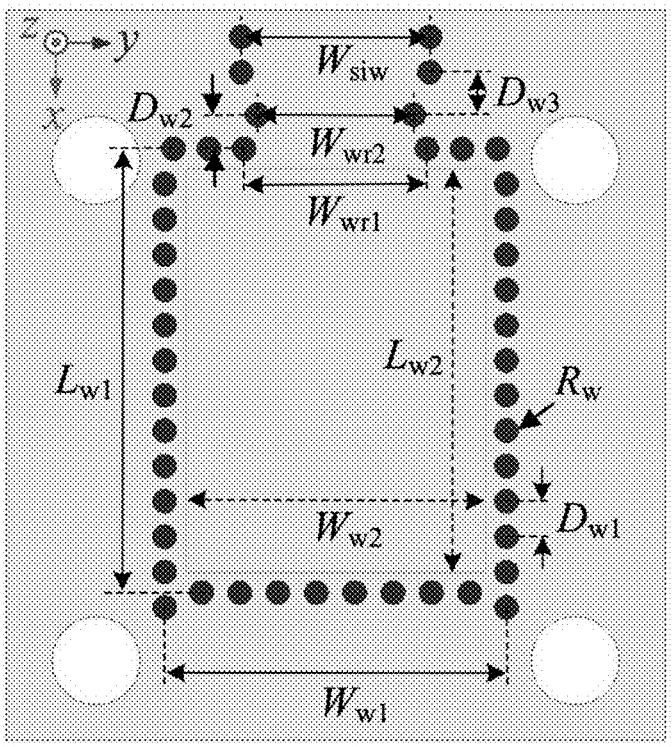
FIG. 10 depicts a top view of one of the layers of FIG. 9.
Figure 11:
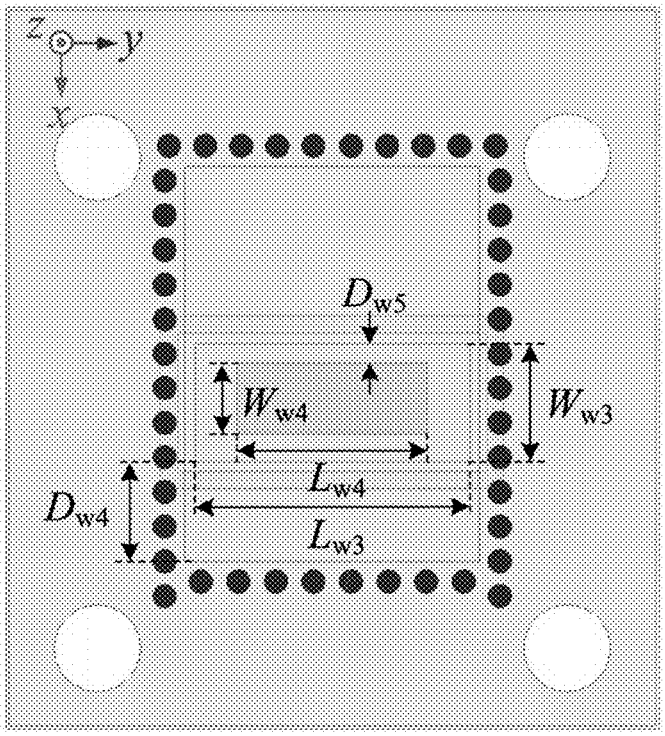
FIG. 11 depicts a top view of another of the layers of FIG. 9.

In order to implement the antenna array, a testing connection for the SIW feeding structure is required. To have a stable testing performance, a waveguide-to-SIW transition is utilized to connect the antenna array for measurement. Typically, for testing antennas without a filtering function, the impedance bandwidth of the waveguide-to-SIW transition structure only needs to match the operating bandwidth of the antenna. However, for the self-filtering antennas of the present invention, a wider impedance bandwidth is needed to enable evaluation of both the in-band and out-of-band performance Thus, ultra-wide impedance bandwidth is required for the transition. Since it is extremely difficult to design one transition working from at least 20 GHz to around 35 GHz (across K and Kα band), two separate transitions respectively working on K and Kα band are designed. The configuration of the transition structure is depicted in FIGS. 9-11. FIG. 9 is a perspective view and FIGS. 10 and 11 are top views of the two substrates. To increase the impedance bandwidth, a two-substrate structure both realized with 0.381-mm-thick Rogers RT/duroid 5880 is used. The dimensions of the features of FIGS. 10 and 11 are listed in Table 2, below.

TABLE 2

DIMENSIONS OF THE TRANSITIONS (UNIT: mm)

| Transition 1 (WR42) | | | | | | | | | |
|---|---|---|---|---|---|---|---|---|---|
| Parameter | $L_{w1}$ | $L_{w2}$ | $L_{w3}$ | $L_{w4}$ | $W_{slw}$ | $W_{wr1}$ | $W_{wr2}$ | $W_{w1}$ | $W_{w2}$ |
| Value | 15.1 | 13.7 | 9.5 | 6.6 | 6.4 | 6.2 | 5.3 | 11.6 | 10.2 |
| Parameter | $W_{w3}$ | $W_{w4}$ | $D_{w1}$ | $D_{w2}$ | $D_{w3}$ | $D_{w4}$ | $D_{w5}$ | $R_w$ | |
| Value | 4.1 | 2.75 | 1.2 | 1.15 | 1.45 | 3.45 | 0.35 | 0.4 | |
| Transition 2 (WR28) | | | | | | | | | |
| Parameter | $L_{w1}$ | $L_{w2}$ | $L_{w3}$ | $L_{w4}$ | $W_{slw}$ | $W_{wr1}$ | $W_{wr2}$ | $W_{w1}$ | $W_{w2}$ |
| Value | 11.5 | 10.1 | 6.6 | 4.5 | 6.4 | 4.7 | 4.7 | 8.6 | 7.2 |
| Parameter | $W_{w3}$ | $W_{w4}$ | $D_{w1}$ | $D_{w2}$ | $D_{w3}$ | $D_{w4}$ | $D_{w5}$ | $R_w$ | |
| Value | 3.36 | 1.9 | 1.2 | 1.1 | 1 | 2.22 | 0.38 | 0.4 | |

Figure 12:
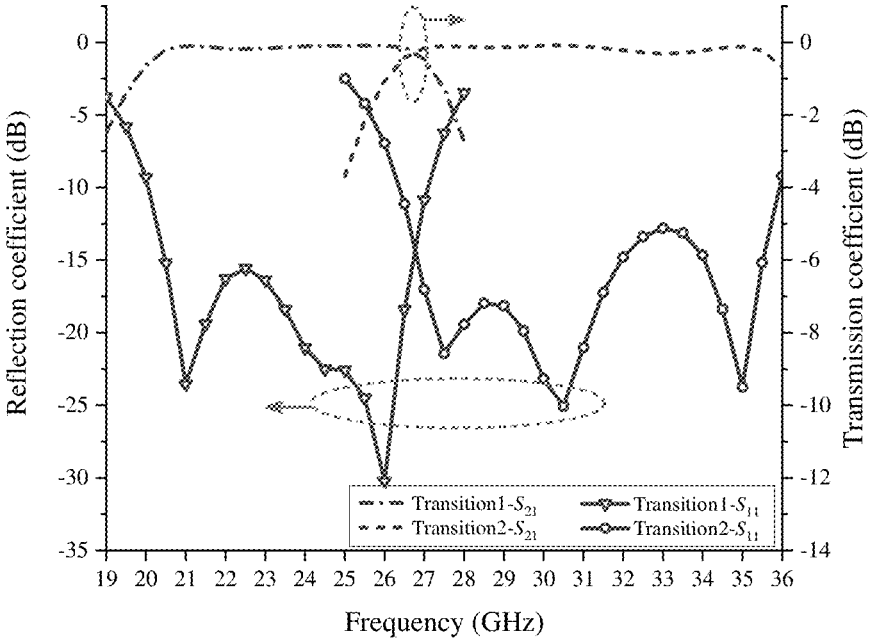
FIG. 12 depicts the simulated performance of a waveguide-to-SIW transition.

FIG. 12 presents the simulated performance of the waveguide-to-SIW transitions. The average insertion loss within the band of 23.5 GHz to 31 GHz is around 0.1 dB. As seen, within the frequency band of 20 to 35 GHz, both the in-band and out-of-band performance of the antenna of the present invention can be well evaluated.

Measurement of Antenna Arrays

Figure 13:
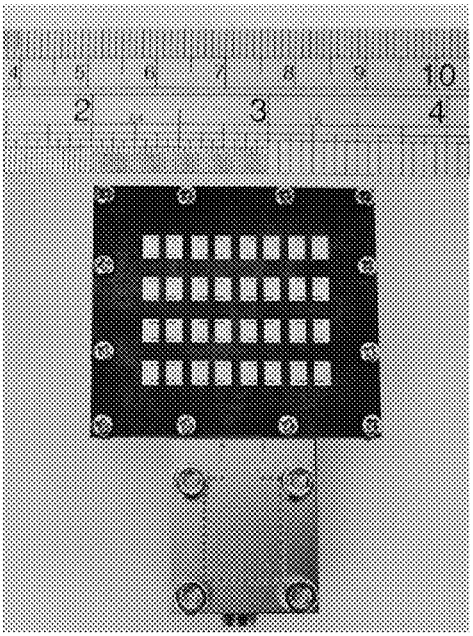
FIG. 13 depicts a fabricated 4×4 antenna array, low-band.
Figure 14:
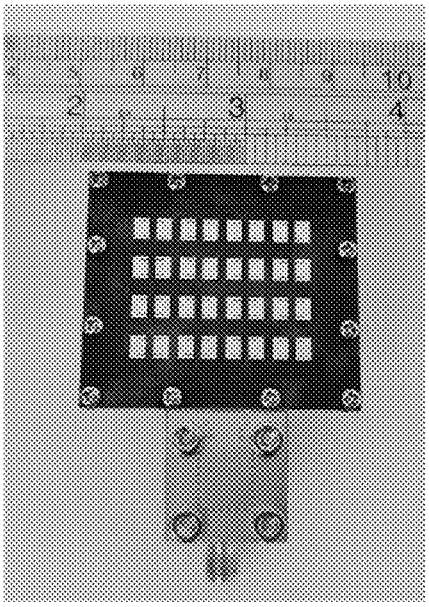
FIG. 14 depicts a fabricated 4×4 antenna array, high-band.

FIGS. 13 and 14 depict examples of fabricated antenna arrays according to the present invention. The antenna arrays were fabricated using substrate boards with single-layer printed-circuit-board (PCB) technology which are then bonded together with the bonding films under appropriate temperature and pressure. The waveguide-to-SIW transitions described above, working in two bands, are respectively connected to the antenna array, forming two different fabrication prototypes.

Figure 15:
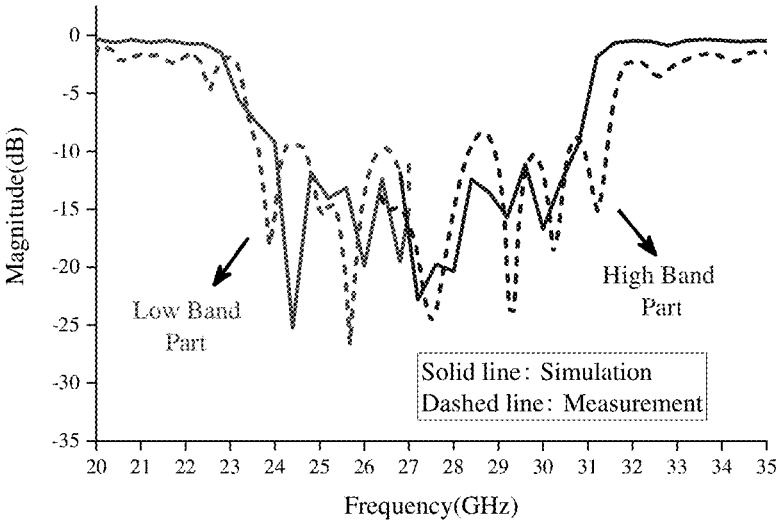
FIG. 15 depicts the simulated and measured reflection coefficient of the antenna array.

An Agilent E8361A Network Analyzer acquired the reflection coefficient response of the antenna arrays. The simulated and measured $|S_{11}|$'s are compared and shown in FIG. 15. As seen, the measured impedance bandwidth covers 29%, from 23.5 GHz to 31.5 GHz. A slight difference between the simulated and measured results is possibly related to fabrication error as well as the variation of the permittivity and loss of the substrates. The radiation properties were measured in a far-field millimeter-wave anechoic chamber.

Figure 16:
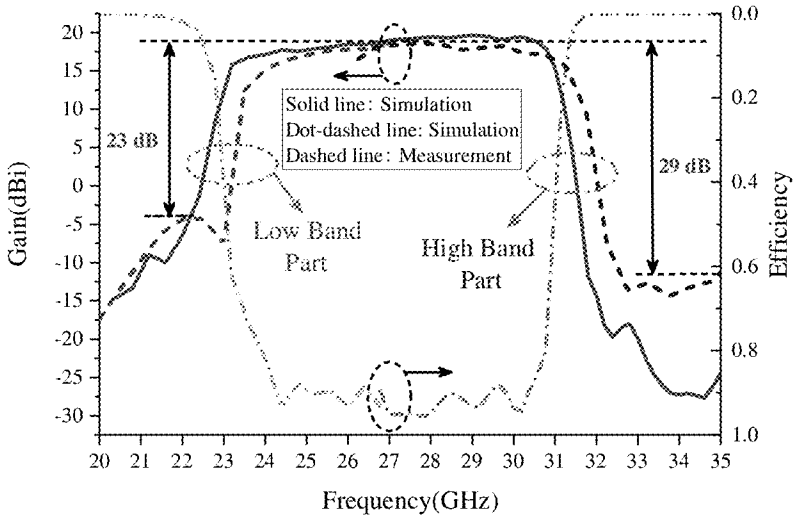
FIG. 16 depicts the simulated and measured gain and efficiency of the antenna array.
Figure 17A:
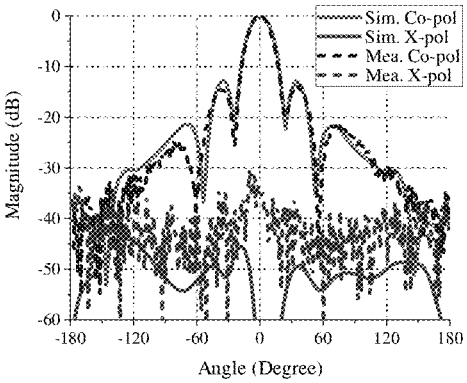
FIGS. 17A-17F depict the simulated and measured radiation patterns of the antenna array: 17A: @24 GHz, E-plane. 17B @24 GHz, H-plane. 17C @27 GHz, E-plane. 17D @27 GHz, H-plane. 17E @30 GHz, E-plane. 17G @30 GHz, H-plane.
Figure 17B:
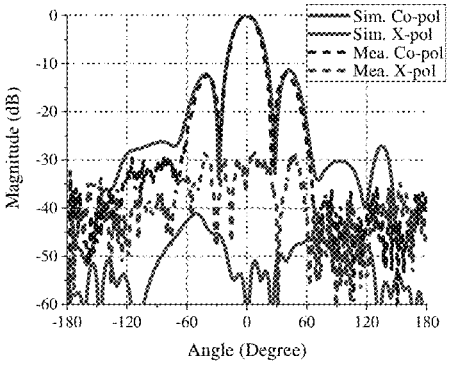
Figure 17C:
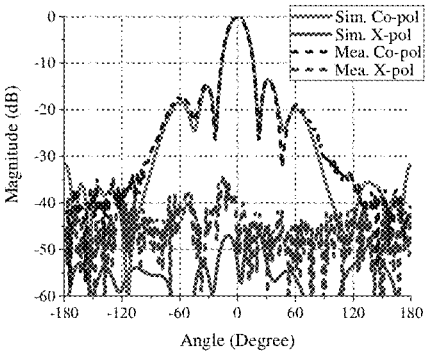
Figure 17D:
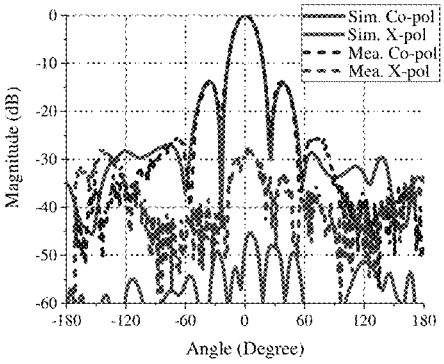
Figure 17E:
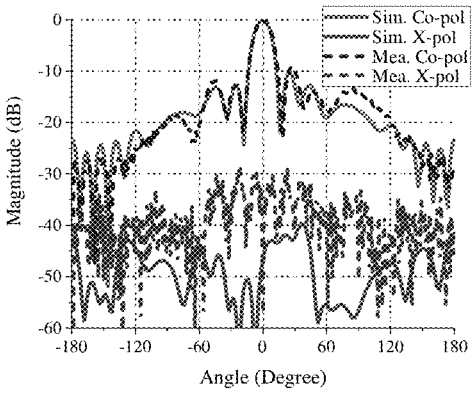
Figure 17F:
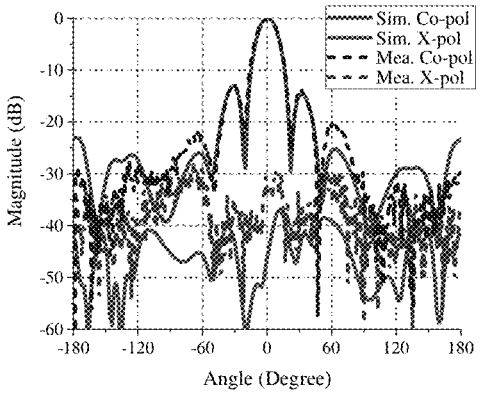

The measured and simulated antenna gains together with the simulated efficiencies are shown in FIG. 16. As seen, the simulated in-band antenna efficiency reaches around 90%. The measured maximum antenna gain within the operating frequency is up to 18.5 dBi, while the simulated one is 19.6 dBi. A sharp roll-off skirt is clearly visible. The out-of-band suppressions in the lower and upper stopband are greater than 23 dB and 29 dB, respectively. A small part of suppression in the stopband can be attributed to the broad-wall coupler. The suppression level can be further improved through improving both the H-shaped power divider and the broad-wall coupler with the same impedance bandwidth as that of the radiating element. However, even without refining the feeding network, the constructed antenna array still demonstrates a high filtering response, proving the functionality of the inventive antennas and antenna arrays.

The simulated and measured radiation patterns are presented in FIGS. 17A-F. Due to the non-radiated SIW feeding network, the antenna array experiences stable broadside radiation with good sidelobe level. Low cross polarization of smaller than −29 dB is obtained in both the E-plane and the H-plane.

INDUSTRIAL APPLICABILITY

The self-filtering antennas of the present invention demonstrate wide impedance bandwidth, good filtering response, and low insertion loss which are achieved, in part, through the SIW structure without the use of extra filtering circuits; The self-filtering antennas can be readily applied in implementation of arbitrary-scale filtering arrays also without the use of any filtering circuits. Consequently, the antennas and antenna arrays may be employed in 5G mm-wave communications. In particular, the antenna array may be applied to 5G mm-wave backhaul communications.

While the present disclosure has been described and illustrated with reference to specific embodiments thereof, these descriptions and illustrations are not limiting. It should be understood by those skilled in the art that various changes may be made and equivalents may be substituted without departing from the true spirit and scope of the present disclosure as defined by the appended claims. The illustrations may not necessarily be drawn to scale. There may be distinctions between the artistic renditions in the present disclosure and the actual apparatus due to manufacturing processes and tolerances. There may be other embodiments of the present disclosure which are not specifically illustrated. The specification and the drawings are to be regarded as illustrative rather than restrictive. Modifications may be made to adapt a particular situation, material, composition of matter, method, or process to the objective, spirit and scope of the present disclosure. All such modifications are intended to be within the scope of the claims appended hereto. While the methods disclosed herein have been described with reference to particular operations performed in a particular order, it will be understood that these operations may be combined, sub-divided, or re-ordered to form an equivalent method without departing from the teachings of the present disclosure. Accordingly, unless specifically indicated herein, the order and grouping of the operations are not limitations.

The invention claimed is:

1. A self-filtering millimeter-wave wideband multilayer planar antenna comprising:

a first layer including a slot feed;

a second layer including at least a pair of probes fed by the slot feed from the first layer; and a third layer including at least two substantially planar radiating patches each respectively coupled to one of the probes on the second layer, wherein the radiating patches are configured to radiate a millimeter-wavelength electromagnetic wave when the slot feed receives excitation energy and transmits the energy to one of the at least two radiating patches through a respective one of the probes.

2. The self-filtering antenna of claim 1, wherein the self-filtering antenna does not include a resonant cavity structure.

3. The self-filtering antenna as recited in claim 1, wherein the first layer is provided on a first substrate including a substrate-integrated waveguide (SIW), wherein the slot feed includes a slot defined on an upper plane of the SIW.

4. The self-filtering antenna as recited in claim 3, further comprising a pair of stubs connected to the upper plane of the first substrate or to a lower plane of the second substrate in a slot region defined by the coupling slot, and wherein the stubs operate at a quarter wavelength.

5. The self-filtering antenna as recited in claim 1, wherein the second layer is provided on a second substrate and the second layer includes a coupling slot aligned with the slot feed on the first layer, and the pair of probes is positioned adjacent to the coupling slot.

6. The self-filtering antenna as recited in claim 5, wherein each of the probes includes a vertical portion and a horizontal portion extending from the vertical portion.

7. The self-filtering antenna as recited in claim 5, further comprising two loops constructed with conducting vias and strips that span across the coupling slot.

8. The self-filtering antenna as recited in claim 1, wherein the pair of probe operates at a quarter wavelength, and wherein the slot feed and the pair of radiating patches operate at half wavelength.

9. An antenna array comprising a plurality of the self-filtering antennas of claim 1.

* * * * *